United States Patent [19]

Lomeli et al.

[11] 4,379,573

[45] Apr. 12, 1983

[54] BUSINESS FORM WITH REMOVABLE LABEL AND METHOD FOR PRODUCING THE SAME

[75] Inventors: Ronald C. Lomeli; Gary E. Stewart, both of Phoenix, Ariz.

[73] Assignee: Trade Printers, Inc., Phoenix, Ariz.

[21] Appl. No.: 188,502

[22] Filed: Oct. 9, 1980

[51] Int. Cl.[3] ..... G09F 3/04

[52] U.S. Cl. ..... 428/42; 283/81

[58] Field of Search ..... 282/23 R, 11.5 A; 283/18, 21; 428/42, 43, 41; 40/2 R

[56] References Cited

U.S. PATENT DOCUMENTS

| | | | |
|---|---|---|---|
| 3,221,427 | 12/1965 | Kaplan | 40/2 R |
| 3,799,829 | 3/1974 | Heatwole | 40/2 R X |
| 3,914,483 | 10/1975 | Stipek, Jr. | 283/18 X |
| 4,277,089 | 7/1981 | Lockhart | 283/18 X |

*Primary Examiner*—Paul A. Bell

*Assistant Examiner*—John S. Brown

*Attorney, Agent, or Firm*—Drummond, Nelson & Nissle

[57] ABSTRACT

A business form having die cut label areas removable therefrom and an improved method for processing paper sheet substrate from a continuous supply thereof to produce the same. The method includes the steps of feeding paper substrate from the continuous supply thereof into paper processing apparatus for guiding and transporting the substrate; imprinting a business format on the paper substrate received by the processing apparatus; adhesively applying pieces of tape at spaced points on the paper substrate received by the processing apparatus to form binary areas on the substrate having greater thickness than the substrate, the binary areas including a pair of layers, a layer of tape applied in relief to the substrate, and a layer of substrate corresponding in surface area to the tape layer; and die cutting one of the layers to form at least one label area adjacent to and peelable from the other layer.

1 Claim, 7 Drawing Figures

FIG. 1
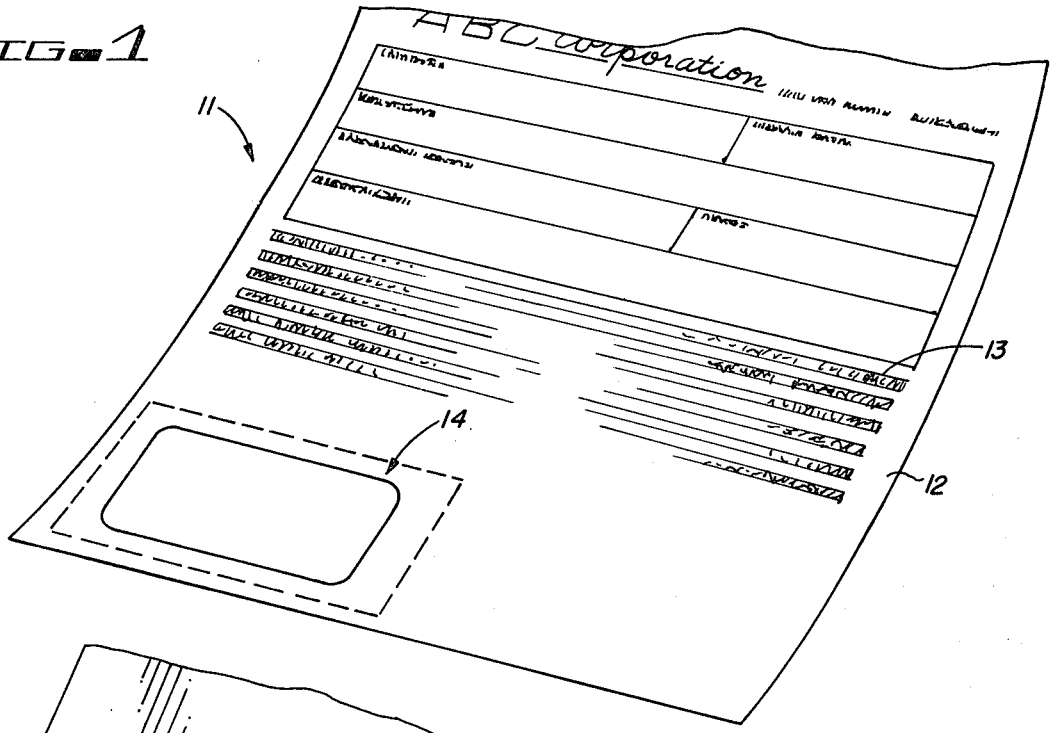
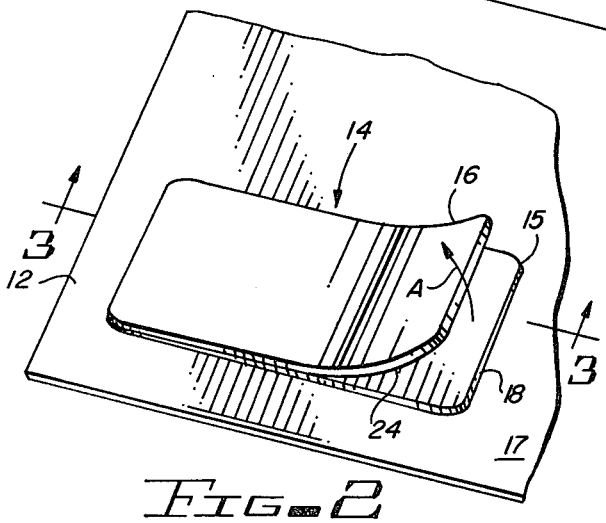
FIG. 2
(PRIOR ART)
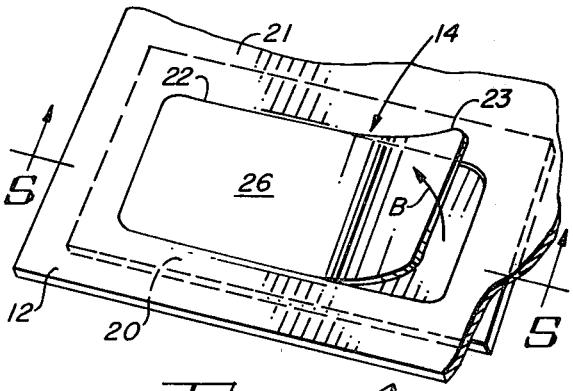
FIG. 4
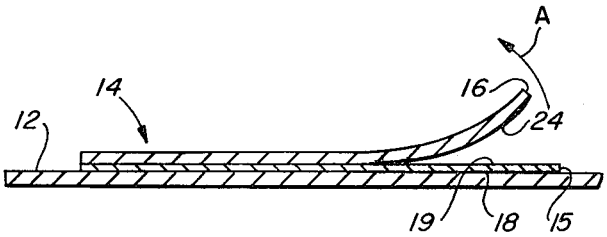
FIG. 3
(PRIOR ART)
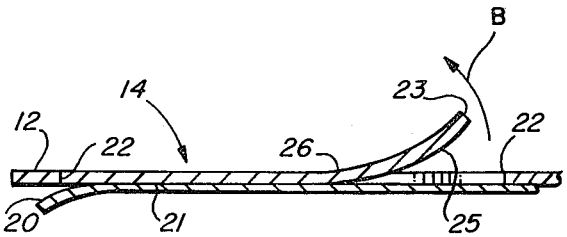
FIG. 5

BUSINESS FORM WITH REMOVABLE LABEL AND METHOD FOR PRODUCING THE SAME

This invention relates to business forms having die cut label areas which are removable therefrom and to a method for producing the same.

More particularly, the invention pertains to a business form which includes an imprinted paper substrate having transfer tape detachably adhesively secured thereto and having a removable die cut area which may be peeled from the transfer tape to form a label.

In a further respect, the instant invention concerns a method for producing a business form having die cut label area removable therefrom in which transfer tape is detachably adhesively secured to an imprinted paper substrate and in which a portion of the substrate adhesively secured to the transfer tape is then die cut to form a removable label area.

In yet another respect, the present invention concerns a method for producing a business form having die cut label area removable therefrom in which the imprinting of paper substrate, adhesive attachment of transfer tape to the substrate, and die cutting of label area are accomplished in one pass of paper substrate through a paper processing machine.

Providing business forms with removable labels has become a widespread practice. Such labels are often imprinted with information which, when combined with the ability to transfer the label, facilitates the completion of a particular business transaction. For instance, a label may be imprinted with the name and address of the company from which the business form originated so that a customer can remove the label from the form and then attach the label to an envelope containing an order being forwarded to the company. Likewise, the label may be imprinted with information identifying the customer so that when the label is attached to an order form processing of the order by the company is expedited.

These so-called "transfer labels" are actually comprised of two layers of material. The first or lower layer has a pressure sensitive adhesive on its bottom surface and an adhesive on its upper surface which detachably secures the second layer—a paper label—thereto. Transfer labels are normally applied to business forms by feeding the forms into a label air machine which blows the transfer labels from a strip of carrier material toward the forms so that the pressure sensitive adhesive on the bottom surface of each label contacts one of the forms.

In many paper manufacturing operations, such as the printing and assembly of business forms, it is common practice to carry out the operation in a series of repetitive steps at spaced points along a continuously moving strip of paper and to then cut the continuous strip into the size required to form the pages of the business form. In particular, multi-part business forms are printed and collated in such fashion and the collated continuous strips of paper cut into the desired size after the final assembly thereof.

In this regard, the principal disadvantage of the conventional label air machine described above is that, in order to apply the transfer labels, business forms cannot be contiuously passed through the machine but must essentially be indexed through the machine one at a time. The usual practice for applying transfer labels to a continuous strip of business forms is to fold the strip in zig-zag fashion along transverse lines of weakening formed in the paper and to then feed the stack of folded paper into the label air machine. Operation of the label air machine requires that each individual form in the stack of folded paper be indexed through the label air machine; i.e., the paper does not continuously move as it passes through the machine, rather, one segment of paper is pulled into the machine, the movement of paper momentarily stops while a label is applied, and then another segment of paper is indexed into the machine. It has become a common industry practice to feed stacks of folded paper into the machine instead of pulling the paper from a roll thereof because the first sheet in a stack can be glued or attached to the final sheet of the stack of paper being fed into the machine. This permits the label air machine to be run continuously. If paper was fed into the machine from a roll, the machine would have to be shut down when the end of a roll was reached so that the core of the old roll could be removed and a new roll installed on the machine.

A further limitation of the label air machine is that the machine is unable to accurately apply labels in the same position on identical business forms. The comparative position of labels blown onto identical business forms by the machine will often vary from 3/16 to ¼ of an inch. The variance in the positioning of labels precludes imprinting the entire surface of the label and, as a consequence, the material to be printed thereon will normally occupy an area substantially less than the surface area of the label to compensate for variance in label position. The inability of the label air machine to consistently place a label in the same position on identical business forms results in a substantial amount of unused and wasted label material.

The conventional label air machine is further limited in operation in that when a plurality of transfer labels or strips are attached side by side to a paper substrate, there must be a minimum distance of approximately two inches between any two labels. This particular limitation rules out the application of a pair of closely spaced labels to a paper substrate.

The printing of business forms is commonly carried out by feeding continuous strips of business forms through high-speed presses at the rate of thousands of copies per hour. To date, a like process which permits both the imprinting of a paper substrate and formation of a removable label on the substrate in a "one-pass" continuous high speed operation has apparently not been utilized. Instead, the conventional process comprises imprinting a continuous strip of paper substrate, folding the strip, running a stack of folded paper through a label air machine to attach the labels, refolding or rolling the continuous strip of labeled paper leaving the label air machine, and then collating, cutting or further imprinting the continuous strips as desired. This process obviously entails repeated manual handling of the paper and the increased production costs associated therewith.

Even assuming that a conventional label air machine were able to be employed in an automated process, three to five percent of the business forms processed by the machine would not be usable because the applied labels would be bent, damaged or failed to adhere to the paper when blown on. In addition, the bi-layered transfer labels employed generally have an average thickness of seven to eight thousandths of an inch. When large numbers of labeled forms are stacked the resulting buildup of label thickness can, especially when a single label is applied to each form, cause the paper stack to list, making handling and storage of the paper awkward.

Accordingly, it would be highly desirable to provide a process for applying labels to a paper substrate which could be automated and utilized at speeds comparable to the rate at which such forms can be printed and which would allow a business form to be printed and provided with a detachable label in a single pass through paper processing equipment, such that special process steps and manual handling of business forms which typically bottleneck the overall paper product manufacturing operation during application of labels to paper substrate are eliminated.

It would also be desirable to provide a business form with a removable label which increased the thickness of the paper substrate a minimal amount.

Therefore, it is a principal object of the invention to provide an improved business form having a label or labels removable therefrom.

Another object of the invention is to provide a method for imprinting and providing a removable label for a business form which allows a continuously moving paper substrate to be imprinted and provided with a removable label during a single pass through paper processing equipment.

A further object of the present invention is to provide a method for providing a paper sheet substrate with a removable label which adds only a small amount of additional thickness to the paper substrate so that the build-up of label thickness when processed forms are stacked for storage is minimized.

Yet another object of the instant invention is to provide a method for imprinting and providing a paper sheet substrate with a removable label which results in a minimal number of defective and unusable business forms after the substrate has been imprinted and provided with removable label areas.

Still another and more specific object of the invention is to provide a method for producing business forms which permit a removable label to be accurately placed in an identical position on each of a plurality of forms.

These and other, further and more specific objects and advantages of the invention will be apparent to those skilled in the art from the following detailed description thereof, taken in conjunction with the drawings, in which:

FIG. 1 is a perspective view of a business form provided with a removable label;

FIG. 2 is a partial perspective view of the business form of FIG. 1 illustrating a prior art removable label attached thereto;

FIG. 3 is a sectional view of the business form of FIG. 2 taken along section line 3—3 thereof;

FIG. 4 is a partial perspective view of the business form of FIG. 1 provided with a removable label in accordance with one embodiment of the present invention;

FIG. 5 is a sectional view of the business form of FIG. 4 taken along section line 5—5 thereof;

Figure 6:
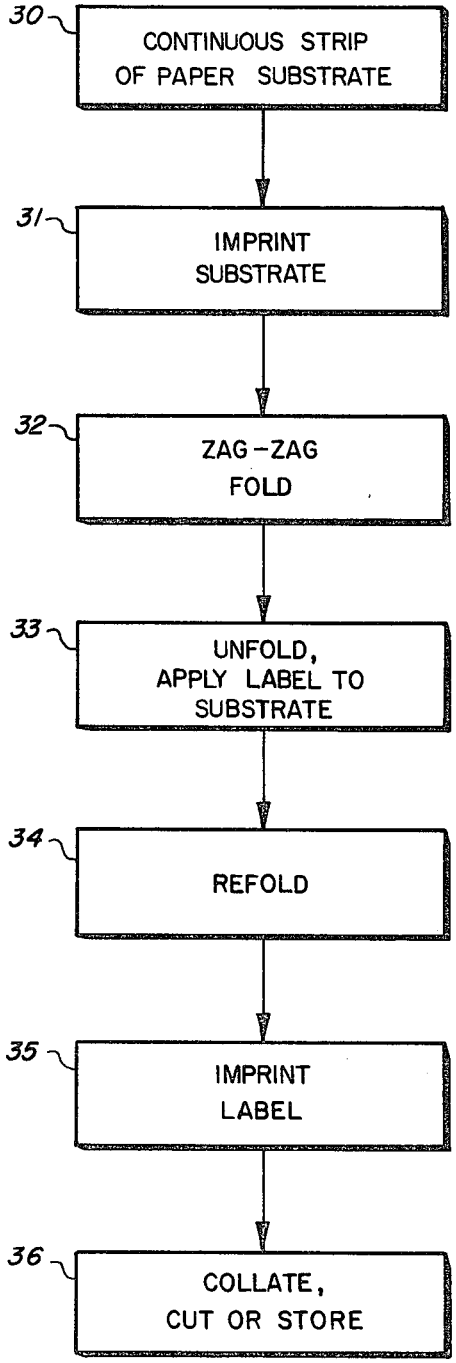
FIG. 6 (PRIOR ART)
FIG. 6 is a flow diagram illustrating a prior art method of producing the business form of FIGS. 1, 2 and 3.

Briefly, in accordance with the invention, I provide a method for processing paper sheet substrate from a continuous supply thereof to produce business forms having die cut label areas removable therefrom. The method includes the steps of feeding paper substrate from the continuous supply into paper processing apparatus which guides and transports the substrate; imprinting a business format on the paper substrate received by the processing apparatus; adhesively applying pieces of tape at spaced points on the paper substrate received by the processing apparatus to form binary areas on the substrate having greater thickness than the substrate, the binary areas including a pair of layers, a first layer of tape applied in relief to the substrate and a second layer of substrate corresponding in surface area to the first layer tape; and die cutting one of the layers to form at least one label area adjacent to and peelable from the other layer.

Another embodiment of the invention includes a business form having die cut label area removable therefrom. The business form comprises an imprinted paper sheet substrate; tape adhesively secured to the substrate at spaced points thereon to form binary areas on the substrate having greater thickness than the substrate, the binary areas including a pair of layers, a first layer of tape applied in relief to the substrate and a second layer of substrate corresponding in surface area to the first layer; and die cut label area in the substrate adjacent to and peelable from the transfer tape.

Turning now to the drawings, which depict the presently preferred embodiments of the invention for the purpose of illustrating the practice thereof and not by way of limitation of the scope of the invention and in which like reference characters represent similar elements throughout the several views, FIG. 1 illustrates a business form generally identified by reference character 11 and consisting of a paper substrate 11 having printed matter 13 and a removable label 14 on the face thereof.

As shown in FIGS. 2 and 3 removable label 14 normally consists of two layers 15, 16. The bottom surface 18 of layer 15 has a pressure sensitive adhesive contacting the upper face 17 of substrate 12. The upper surface 19 of layer 15 is provided with an adhesive which removably secures layer 16 thereto. When desired layer 16 is peeled from layer 15 in the direction of arrow A to form a label. Adhesive on the lower surface 24 of layer 16 permits layer 16 to be affixed to another paper form. The combined thickness of layers 15, 16 is approximately seven to eight thousandths of an inch.

A label 14 formed in substrate 12 in accordance with one embodiment of the invention is illustrated in FIGS. 4 and 5. Upper surface 20 of layer 21 is provided with adhesive which transfers from layer 21 to the bottom surface 25 of substrate 12 when layer 21 is attached thereto. After layer 21 is adhesively secured to substrate 12 the substrate 12 is die cut along line 22 to form label 23 which is peelable from layer 21 in the direction of arrow B. Label 23 may, due to adhesive transferred thereto from layer 21, be secured to an ancillary piece of paper. Layer 21 has a thickness of approximately three thousandths of an inch.

A conventional prior art process for producing the business form of FIGS. 1, 2 and 3 is illustrated by the flow chart of FIG. 6. A continuous strip of paper substrate 30 is imprinted with a business format 31 and folded 32 in a zig-zag fashion along transverse lines of weakening formed therein. The business forms contained in the stack of folded paper are indexed one at a time through a label air machine which applies to labels 14 of FIGS. 2 and 3 to the paper substrate 12 of form 11.

Labeled forms dispensed by the label air machine are refolded 34. The stack of refolded business forms is run through a press to imprint 35 data on removable labels 14. The finished business forms are collated with another strip of paper substrate or carbon paper, are cut, or are stored as desired. Application of labels 14 by the label air machine is a relatively slow process, and the necessity of folding a strip of continuous forms before and after processing by the label air machine creates a bottleneck in the overall process of producing business forms 11 having removable labels 14.

Figure 7:
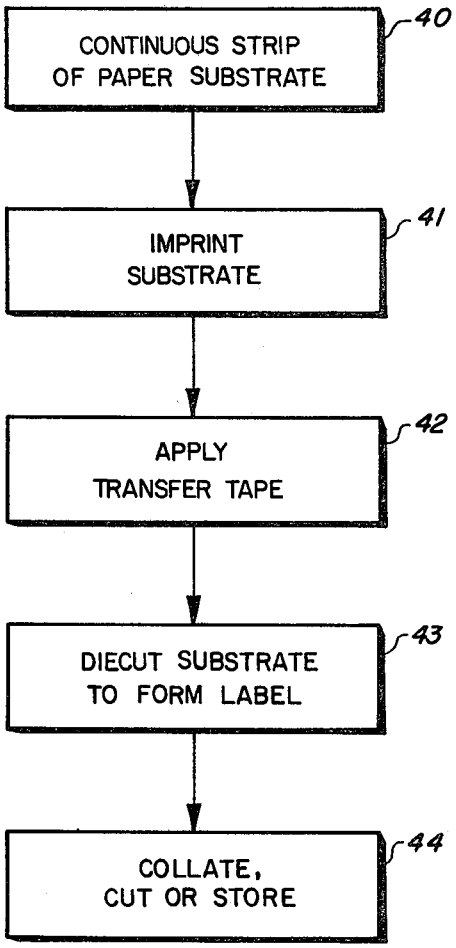
FIG. 7 is a flow diagram illustrating a process for producing a business form having a removable label in accorrdance with another embodiment of the invention.

As illustrated in FIG. 7, an improved process of the invention allows paper substrate from a supply of individual sheets or of a continuous strip thereof to both be imprinted with a business format and be provided with removable labels during a single pass through paper process apparatus. In the improved process, paper substrate 40 from a continuous supply thereof is imprinted 41 with a business format. Transfer tape is adhesively applied 42 to the paper substrate 12 to form bi-layer areas along the substrate comprising an area of transfer tape adhesively secured to an equivalent adjacent area of the original paper substrate. One of the pair of layers is die cut 43 to form label area which is peelable from the adjacent layer. Since the steps of imprinting 41, die cutting 43 and applying transfer tape 42 can each be carried out on a rapidly moving sheet of paper, the entire process of imprinting and providing a removable label for a paper substrate may be completed during a single pass of the substrate through high speed paper processing apparatus. The step of imprinting 41 the substrate may, of course, be performed after application of the transfer tape or after the substrate is die cut.

A variety of transfer tapes 21 may be applied to substrate 12 during the processing shown in FIG. 7. In the presently preferred embodiment of the invention surface 20 of tape 21 is provided with an adhesive which adheres to substrate 12 and separates from the upper surface 20 of tape 21 when label 23 is peeled off in the direction of arrow B (see FIG. 5). However, the lower surface 25 of substrate 12 may be provided with a smooth surface of hardened adhesive which becomes tacky on contact with water. In this case, the adhesive on surface 20 would continue to adhere to tape 21 when label 23 was removed. In some instances it might also be desirable for the surface 20 of transfer tape 21 to have a pressure sensitive carbon layer which would reproduce information imprinted on the upper surface 26 of label 23.

Removable labels similar to the labels pictured in FIGS. 2 and 3 can be attached by a label air machine to the same position on a plurality of business forms only to within a variance of from 3/16 to ¼ of an inch. In contrast, when the process of FIG. 7 is utilized labels can be die cut at an identical position on a plurality of forms with a variance in position which is substantially less. The improved accuracy of label placement inherent in die cutting the label allows a larger area of the label surface to be imprinted, reducing the amount of label material required.

A further benefit of the process of FIG. 7 is that when one of the layers 21, 12 is die cut to form removable label area, if a plurality of labels is formed, the labels may be closely adjacent one another. There is no minimum spacing requirement similar to that earlier described in the label air machine. In addition, the number of defective and unusable business forms produced during the process of FIG. 7 is less than the accepted industry standard of 3–5% of total production for the label air machine.

Having described my invention in such terms as to enable those skilled in the art to understand and practice it, and having identified the presently preferred embodiments thereof, I claim:

1. A business form having a die cut label area removable therefrom, said form including (a) a sheet of paper having a back side, an imprinted front side and an outer peripheral edge;

(b) at least one piece of transfer tape including a layer of adhesive adjacent a layer of backing material and having an outer peripheral edge, said tape being secured to a limited area on the back of said paper sheet by contacting said sheet with said layer of adhesive such that the outer peripheral edge of said piece of transfer tape generally lies within said outer peripheral edge of said paper sheet; and (c) a label area die cut in said sheet of paper above said piece of transfer tape and having an outer peripheral edge, (i) the outer peripheral edge of said die cut label generally lying within the outer peripheral edge of said transfer tape, (ii) a portion of said business form lying between the peripheral edge of said die cut label and the peripheral edge of said transfer tape and including a first portion of said layer of adhesive sandwiched between a section of said sheet of paper and a section of the layer of backing material of said transfer tape, and (iii) a second portion of said layer of adhesive lying between said label and said layer of backing material of said transfer tape, and adhering to said label and separating from said backing material when said label is peeled away from said backing material, and said transfer tape being sized such that said first portion of adhesive in said portion of said business form between the peripheral edge of said die cut label and the peripheral edge of said transfer tape is sufficient to maintain said transfer tape in position on said paper sheet when said label is peeled from said backing material of said transfer tape.

* * * * *